US011546695B2

(12) United States Patent
Xiao et al.

(10) Patent No.: US 11,546,695 B2
(45) Date of Patent: Jan. 3, 2023

(54) SPEAKER

(71) Applicant: AAC Microtech (Changzhou) Co., Ltd., Changzhou (CN)

(72) Inventors: Bo Xiao, Shenzhen (CN); Chenliang Kong, Shenzhen (CN); Tong Zhang, Shenzhen (CN); Ronglin Linghu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/553,821

(22) Filed: Dec. 17, 2021

(65) Prior Publication Data

US 2022/0210568 A1 Jun. 30, 2022

(30) Foreign Application Priority Data

Dec. 25, 2020 (CN) ..... 202023207064.9

(51) Int. Cl.
*H04R 9/02* (2006.01)
*H04R 7/18* (2006.01)

(52) U.S. Cl.
CPC ..... *H04R 9/025* (2013.01); *H04R 7/18* (2013.01); *H04R 2400/07* (2013.01); *H04R 2400/11* (2013.01)

(58) Field of Classification Search
CPC ..... H04R 9/025; H04R 7/18; H04R 2400/07; H04R 2400/11
See application file for complete search history.

(56) References Cited

U.S. PATENT DOCUMENTS

2019/0104369 A1* 4/2019 Kim ..... H04R 9/043
2020/0413199 A1* 12/2020 Song ..... H04R 9/06

FOREIGN PATENT DOCUMENTS

CN 109362005 B * 3/2021 ..... H04R 9/025

* cited by examiner

*Primary Examiner* — Sunita Joshi
(74) *Attorney, Agent, or Firm* — W&G Law Group

(57) ABSTRACT

Provided is a speaker, including a frame; a vibration unit; and a magnetic circuit unit. The magnetic circuit unit is provided with a magnetic gap; the vibration unit includes a diaphragm, and a voice coil; the magnetic circuit unit includes a yoke, a main magnet unit, and auxiliary magnet units, and the auxiliary magnet units and the main magnet unit define the magnetic gap; the vibration unit further includes two elastic support assemblies; each of which includes an elastic member and an auxiliary diaphragm; the elastic member includes a first fixing arm, a second fixing arm and an elastic arm; the auxiliary diaphragm includes an auxiliary suspension, and a first connecting portion and a second connecting portion; and the auxiliary suspension has a racetrack shape with notches. With this structure, the service life and reliability of the speaker are improved.

9 Claims, 4 Drawing Sheets

A–A

SPEAKER

TECHNICAL FIELD

The present disclosure relates to the field of electro-acoustic conversion, in particular to a speaker for an electronic audio product.

BACKGROUND

Speakers are used in electronic audio products to convert electrical signals into sound signals.

In the related art, a speaker includes a frame, a vibration unit fixed to the frame and a magnetic circuit unit provided with a magnetic gap. The magnetic circuit unit drives the vibration unit to vibrate and produce sound. The vibration unit includes a diaphragm, a voice coil inserted in the magnetic gap to drive the diaphragm to vibrate and produce sound, an elastic member fixed to the frame, an auxiliary diaphragm attached to the elastic member, and a holder connecting the voice coil and the diaphragm.

The magnetic circuit unit interferes with the auxiliary diaphragm, thereby causing the elastic member to be easily broken, and thus affecting the service life and reliability of the speaker.

Therefore, it needs to provide a speaker to solve the above technical problem.

SUMMARY

An objective of the present disclosure is to provide a speaker with long service life and high reliability.

An embodiment of the present disclosure provides a speaker, including a frame; a vibration unit supported in the frame; and a magnetic circuit unit driving the vibration unit to vibrate and produce sound. The magnetic circuit unit is provided with a magnetic gap; the vibration unit includes a diaphragm, and a voice coil inserted in the magnetic gap to drive the diaphragm to vibrate and produce sound; the magnetic circuit unit includes a yoke fixed to the frame, a main magnet unit fixed to the yoke, and auxiliary magnet units located at two opposite sides of the main magnet unit and spaced apart from the main magnet unit, and the auxiliary magnet units and the main magnet unit define the magnetic gap; the voice coil has a rectangular structure with round corners; the vibration unit further includes two elastic support assemblies fixed to the frame and opposite to and spaced apart from the diaphragm; the two elastic support assemblies are located at two opposite sides of a short axis of the voice coil; each of the two elastic support assemblies includes an elastic member fixed to the frame, and an auxiliary diaphragm attached to a side of the elastic member away from the diaphragm and spaced apart from the auxiliary magnet unit; the elastic member includes a first fixing arm fixed to the frame, at least one second fixing arm spaced apart from the first fixing arm to support the voice coil, and at least one elastic arm connecting the first fixing arm and the at least one second fixing arm; the auxiliary diaphragm includes an auxiliary suspension, and a first connecting portion and a second connecting portion that respectively bend and extend from two opposite sides of the auxiliary suspension; the first connecting portion is attached to the first fixing arm, and the second connecting portion is attached to the at least one second fixing arm; the auxiliary suspension is directly opposite to and spaced apart from the at least one elastic arm; and the auxiliary suspension has a racetrack shape with notches passing through the racetrack, and the notches are formed at two opposite sides of a long axis of the voice coil.

As an improvement, the auxiliary magnet unit includes first auxiliary magnet units located at two opposite sides of the long axis of the voice coil and second auxiliary magnet units located at two opposite sides of the short axis of the voice coil; and the auxiliary diaphragms of the two elastic support assemblies are located at two opposite sides of the short axis of the voice coil and are spaced apart sides of the second auxiliary magnet units away from the voice coil.

As an improvement, the vibration unit further includes a holder configured to connect the diaphragm and the voice coil.

As an improvement, the holder includes four body portions attached to the round corners of the voice coil, a first extension wall bending and extending from sides of the four body portions away from the voice coil toward the frame and connected to the at least one second fixing arm, and a second extension wall bending and extending from a side of the first extension wall away from the four body portions to be connected to the diaphragm; the voice coil, the first extension wall and the second extension wall define an accommodating groove; and the first auxiliary magnet units and the second auxiliary magnet units are accommodated in the accommodating groove.

As an improvement, the elastic member includes two second fixing arms and two elastic arms; and the two elastic arms extend from the first fixing arm to be connected to the two second fixing arms.

As an improvement, the diaphragm includes a first suspension portion having a ring shape, a second suspension portion having a ring shape and spaced apart from and surrounding the first suspension portion, and a vibrating portion having a ring shape and located between the first suspension portion and the second suspension portion; a side of the first suspension portion away from the second suspension portion is fixed to the main magnet unit; a side of the second suspension portion away from the first suspension portion is fixed to the frame; a side of the first suspension portion close to the second suspension portion and a side of the second suspension portion close to the first suspension portion are attached to a side of the vibrating portion away from the voice coil; the second extension wall is attached to a side of the vibrating portion close to the voice coil; and the main magnet unit at least partially protrudes, through the first suspension portion, to be exposed to the diaphragm.

As an improvement, the first suspension portion includes a first fixing portion attached to the vibrating portion, a first suspension bending and extending from a periphery of the first fixing portion, a second fixing portion bending and extending from the first suspension and fixed to the main magnet unit, and a through hole penetrating through the second fixing portion; the main magnet unit is partially exposed, through the through hole, to an accommodating space defined by the diaphragm, the frame and the yoke; and the second suspension portion includes a third fixing portion attached to the vibrating portion, a second suspension bending and extending from a periphery of the third fixing portion, and a fourth fixing portion bending and extending from the second suspension and fixed to the frame.

As an improvement, the first suspension and the second suspension are recessed toward opposite directions.

As an improvement, the first suspension bends and extends from the periphery of the first fixing portion in a direction away from the magnetic circuit unit, and the second suspension bends and extends from the periphery of the third fixing portion in a direction toward the magnetic circuit unit.

Compared with the related art, in the present disclosure, the vibration unit includes elastic support assemblies fixed to the frame and opposite to and spaced apart from the diaphragm. Two elastic support assemblies are provided and located at two opposite sides of a short axis of the voice coil. The elastic support assemblies each include an elastic member fixed to the frame and an auxiliary diaphragm attached to a side of the elastic member away from the diaphragm and spaced apart from the auxiliary magnet unit. The elastic member includes a first fixing arm fixed to the frame, second fixing arms spaced apart from the first fixing arm to support the voice coil, and elastic arms connecting the first fixing arm and the second fixing arms. The auxiliary diaphragm includes an auxiliary suspension, and a first connecting portion and a second connecting portion that respectively bend and extend from two opposite sides of the auxiliary suspension. The first connecting portion is attached to the first fixing arm, and the second connecting portion is attached to the second fixing arms. The auxiliary suspension is directly opposite to and spaced apart from the elastic arms. The auxiliary suspension has a racetrack shape with notches passing through the racetrack. The notches are formed at two opposite sides of a long axis of the voice coil. With this structure, when the speaker is working, the auxiliary magnet units and the auxiliary diaphragms do not interfere with each other, such that the elastic members will not be easily broken, thereby greatly increasing the service life of the elastic members. In addition, the auxiliary diaphragms located at two opposite sides of a short axis of the voice coil each are a complete structure, without needing to provide an avoiding hole to avoid the auxiliary magnet units to prevent interference. Therefore, this structure strengthens the lateral rigidity of the vibration unit and effectively balances the lateral swing of the speaker, thereby improving the stability of the speaker.

BRIEF DESCRIPTION OF DRAWINGS

To describe the technical solutions in the embodiments of the present disclosure more clearly, the drawings required for describing the embodiments are briefly described below. Apparently, the drawings in the following description show merely some embodiments of the present disclosure, and those of ordinary skill in the art may still derive other drawings from these drawings without creative efforts.

DETAILED DESCRIPTION OF EMBODIMENTS

The technical solutions of the embodiments of the present disclosure are described in detail below with reference to the drawings. Apparently, the described embodiments are merely some rather than all of the embodiments of the present disclosure. All other embodiments obtained by those of ordinary skill in the art based on the embodiments of the present disclosure without creative efforts should fall within the protection scope of the present disclosure.

Figure 1:
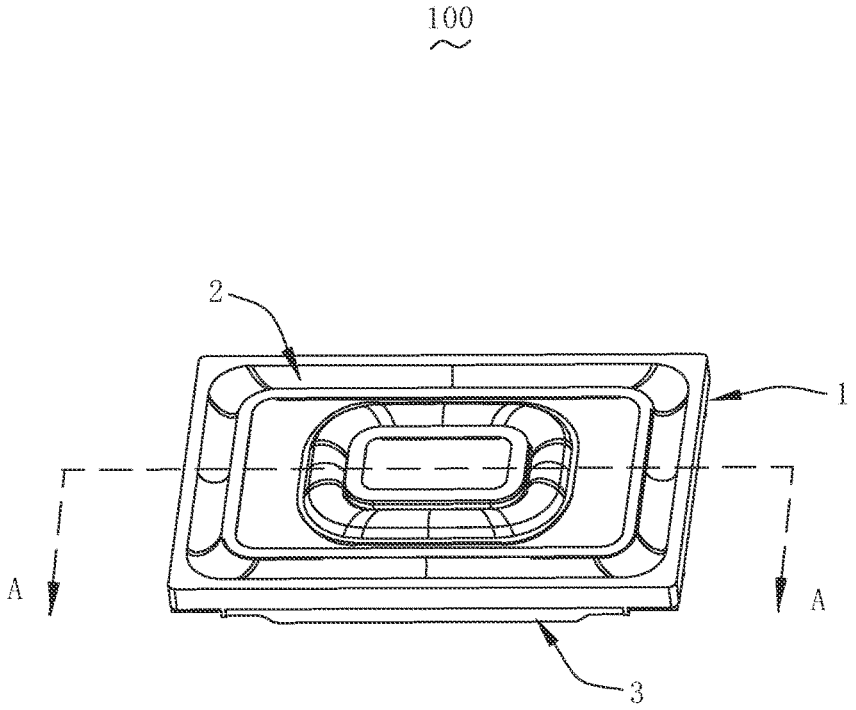
FIG. 1 is a three-dimensional view illustrating a structure of a speaker according to an embodiment of the present disclosure.
Figure 2:
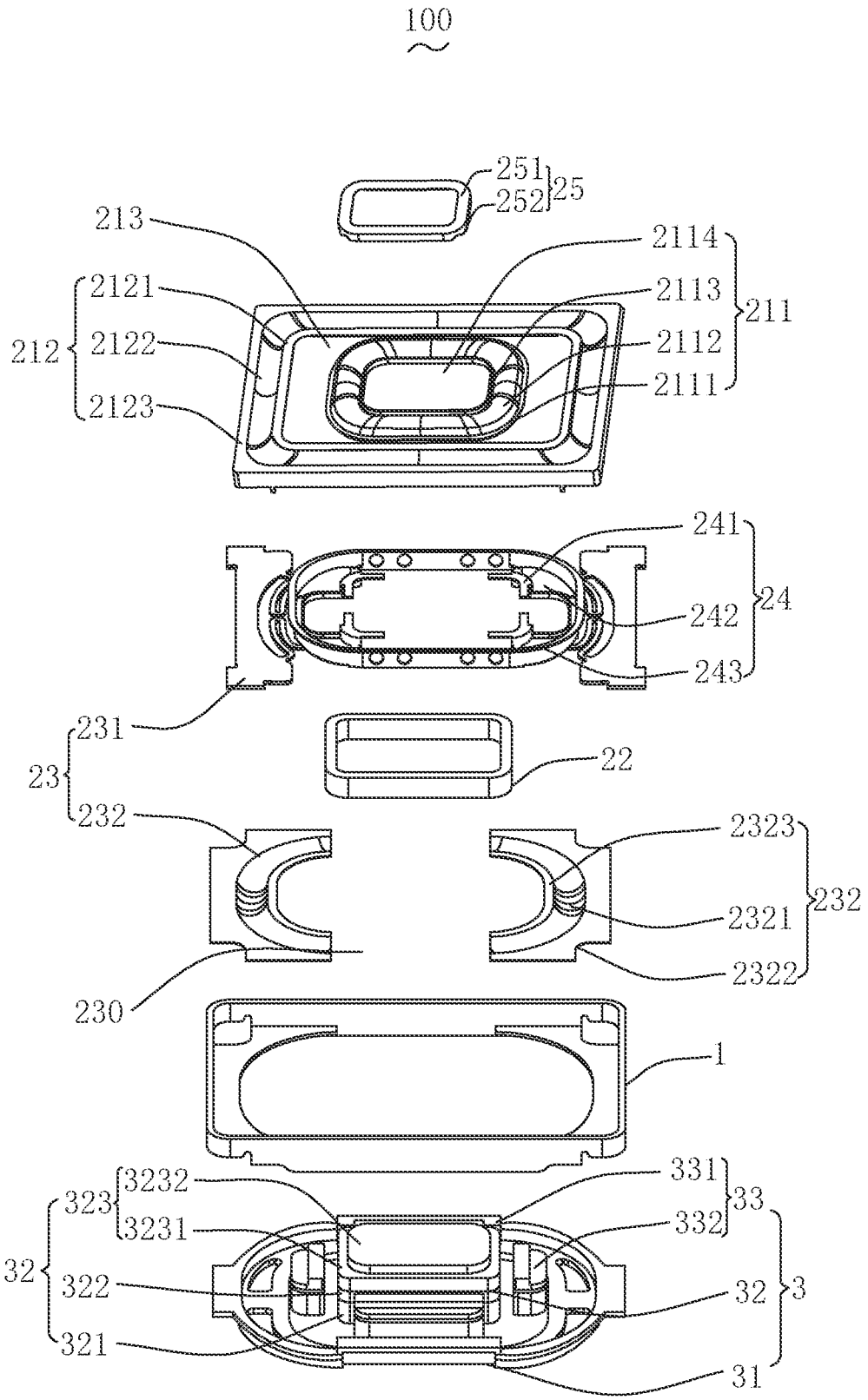
FIG. 2 is a three-dimensional exploded view illustrating a structure of a speaker according to an embodiment of the present disclosure.
Figure 3:
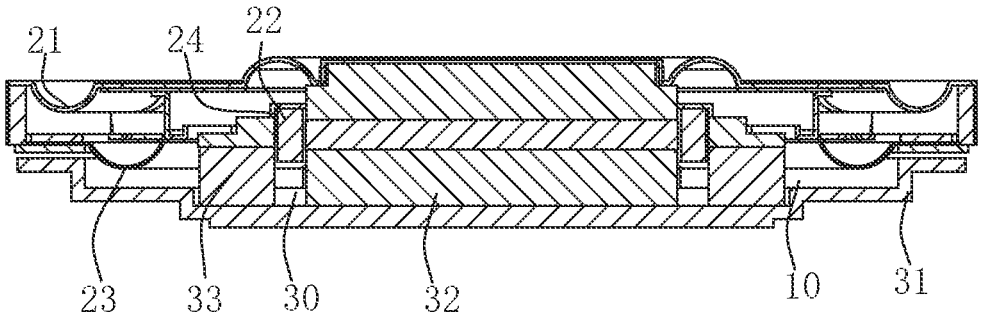
FIG. 3 is a sectional view taken along line A-A shown in FIG. 1.
Figure 4:
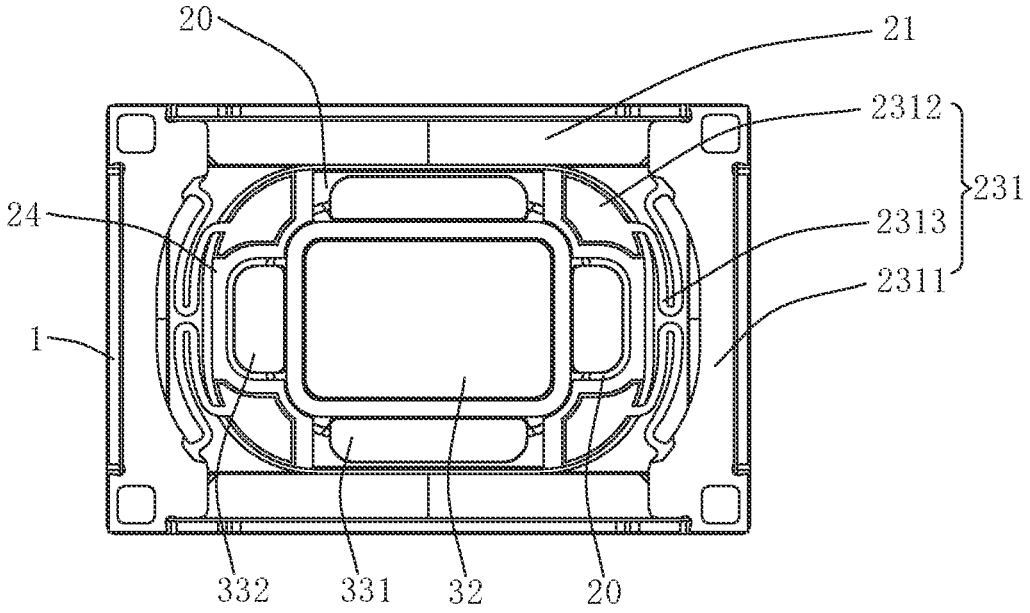
FIG. 4 is a partial three-dimensional view illustrating a structure of a speaker according to an embodiment of the present disclosure.

Referring to FIG. 1 to FIG. 4, an embodiment of the present disclosure provides a speaker 100. The speaker 100 includes a frame 1, a vibration unit 2 supported in the frame 1 and a magnetic circuit unit 3 driving the vibration unit 2 to vibrate and produce sound. The magnetic circuit unit 3 is provided with a magnetic gap 30.

The vibration unit 2 includes a diaphragm 21, a voice coil 22 inserted in the magnetic gap 30 to drive the diaphragm 21 to vibrate and produce sound, elastic support assemblies 23 fixed to the frame 1 and opposite to and spaced apart from the diaphragm 21, and a holder 24 connecting the diaphragm 21 and the voice coil 22.

The magnetic circuit unit 3 includes a yoke 31 fixed to the frame 1, a main magnet unit 32 fixed to the yoke 31, and auxiliary magnet units 33 arranged at two opposite side of the main magnet units 32 and spaced apart from the main magnet unit 32. The auxiliary magnet units 33 and the main magnet unit 32 define the magnetic gap 30.

Specifically, the voice coil 22 has a rectangular structure with round corners. Two elastic support assemblies 23 are provided are located at two opposite sides of a short axis of the voice coil 22. The elastic support assemblies 23 each include an elastic member 231 fixed to the frame 1, and an auxiliary diaphragm 232 attached to a side of the elastic member 231 away from the diaphragm 21 and spaced apart from the auxiliary magnet unit 33. The elastic member 231 is a flexible printed circuit (FPC).

In this embodiment, the elastic member 231 includes a first fixing arm 2311 fixed to the frame 1, second fixing arms 2312 spaced apart from the first fixing arm 2311 to support the voice coil 22, and elastic arms 2313 connecting the first fixing arm 2311 and the second fixing arms 2312. The auxiliary diaphragm 232 includes an auxiliary suspension 2321, and a first connecting portion 2322 and a second connecting portion 2323 that respectively bend and extend from two opposite sides of the auxiliary suspension 2321. The first connecting portion 2322 is attached to the first fixing arm 2311, and the second connecting portion 2323 is attached to the second fixing arms 2312. The auxiliary suspension 2321 is directly opposite to and spaced apart from the elastic arms 2313. The auxiliary suspension 2321 has a racetrack shape with notches 230 passing through the racetrack. The notches 230 are formed at two opposite sides of a long axis of the voice coil 22. With this structure, when the speaker is working, the auxiliary magnet units and the auxiliary diaphragms do not interfere with each other, such that the elastic members will not be easily broken, thereby greatly increasing the service life of the elastic members. In addition, the auxiliary diaphragms located at two opposite sides of a short axis of the voice coil are each a complete structure, without needing to provide an avoiding hole to avoid the auxiliary magnet units to prevent interference. Therefore, this structure strengthens the lateral rigidity of the vibration unit and effectively balances the lateral swing of the speaker, thereby improving the stability of the speaker.

In an embodiment, in order to further increase the flexibility of the elastic member 231, the elastic member 231 includes two second fixing arms 2312 and two elastic arms 2313. The two elastic arms 2313 extend from the first fixing arm 2311 to be connected to the two second fixing arms 2312 respectively.

Further, the auxiliary magnet unit 33 includes first auxiliary magnet units 331 located at the two opposite sides of the long axis of the voice coil 22, and second auxiliary magnet units 332 located at two opposite sides of the short axis of the voice coil 22. The auxiliary diaphragms 232 are located at two opposite sides of the short axis of the voice coil 22 and are spaced apart from sides of the second auxiliary magnet units 332 away from the voice coil 22.

The holder 24 includes four body portions 241 attached to the round corners of the voice coil 22, first extension walls 242 bending and extending from sides of the body portions 241 away from the voice coil 22 toward the frame 1 and connected to the second fixing arms 2312, and a second extension wall 243 bending and extending from sides of the first extension walls 242 away from the body portions 241 to be connected to the diaphragm 21. The voice coil 22, the first extension walls 242, and the second extension wall 243 define an accommodating groove 20. The first auxiliary magnet units 331 and the second auxiliary magnet units 332 are accommodated in the accommodating groove 20.

In the above structure, the accommodating groove plays a role of positioning, which improves the positioning accuracy of the first auxiliary magnet units and the second auxiliary magnet units during assembly, thereby reducing assembly errors and improving assembly efficiency.

In this embodiment, the diaphragm 21 includes a ring-shaped first suspension portion 211, a ring-shaped second suspension portion 212 spaced apart from and surrounding the first suspension portion 211, and a ring-shaped vibrating portion 213 located between the first suspension portion 211 and the second suspension portion 212. A side of the first suspension portion 211 away from the second suspension portion 212 is fixed to the main magnet unit 32. A side of the second suspension portion 212 away from the first suspension portion 211 is fixed to the frame 1. A side of the first suspension portion 211 close to the second suspension portion 212 and a side of the second suspension portion 212 close to the first suspension portion 211 are both attached to a side of the vibrating portion 213 away from the voice coil 22. The second extension wall 243 is attached to a side of the vibrating portion 213 close to the voice coil 22. The main magnet unit 32 at least partially protrudes through the first suspension portion 211 to be exposed to the diaphragm 21. With this structure, the diaphragm has double suspensions, thereby improving the vibration effect of the diaphragm and increasing the frequency-band adjustable factors, and thus improving the acoustic performance of the speaker 100.

Further, the first suspension portion 211 includes a first fixing portion 2111 attached to the vibrating portion 213, a first suspension 2112 bending and extending from a periphery of the first fixing portion 2111, a second fixing portion 2113 bending and extending from the first suspension 2112 and fixed to the main magnet unit 32, and a through hole 2114 penetrating through the second fixing portion 2113. The main magnet unit 32 is partially exposed, through the through hole 2114, to an accommodating space 10 defined by the diaphragm 21, the frame 1 and the yoke 31. The second suspension portion 212 includes a third fixing portion 2121 attached to the vibrating portion 213, a second suspension 2122 bending and extending from a periphery of the third fixing portion 2121, and a fourth fixing portion 2123 bending and extending from the second suspension 2122 and fixed to the frame 1.

In order to further improve the vibration effect of the diaphragm and the acoustic performance of the speaker, in an embodiment, the first suspension 2112 and the second suspension 2122 are recessed in opposite directions. Specifically, the first suspension 2112 bends and extends from a periphery of the first fixing portion 2111 in a direction away from the magnetic circuit unit 3, and the second suspension 2122 bends and extends from a periphery of the third fixing portion 2121 toward the magnetic circuit unit 3.

Further, the main magnet unit 32 includes a first magnet 321, a first pole plate 322 and a second magnet 323 that are sequentially stacked on the yoke 31. The second magnet 323 includes a body portion 3231 fixed to the first pole plate 322, and a protrusion portion 3232 protruding from the body portion 3231. The protrusion portion 3232 is exposed to the accommodating space 10 through the through hole 2114.

In this embodiment, the vibration unit 2 further includes a pressure plate 25. The pressing plate 25 includes a flat portion 251 attached to s side of the protrusion portion 3232 away from the first pole plate 322, and an extension portion 252 bending and extending from an outer periphery of the flat portion 251. The extension portion 252 abuts against the second fixing portion 2113. This structure improves the overall rigidity and stability of the speaker 100.

In an embodiment, in order to further improve the overall rigidity of the speaker 100, the pressure plate 25 is made of a metal material.

Compared with the related art, in the present disclosure, the vibration unit includes elastic support assemblies fixed to the frame and opposite to and spaced apart from the diaphragm. Two elastic support assemblies are provided and located at two opposite sides of a short axis of the voice coil. The elastic support assemblies each include an elastic member fixed to the frame and an auxiliary diaphragm attached to a side of the elastic member away from the diaphragm and spaced apart from the auxiliary magnet unit. The elastic member includes a first fixing arm fixed to the frame, second fixing arms spaced apart from the first fixing arm to support the voice coil, and elastic arms connecting the first fixing arm and the second fixing arms. The auxiliary diaphragm includes an auxiliary suspension, and a first connecting portion and a second connecting portion that respectively bend and extend from two opposite sides of the auxiliary suspension. The first connecting portion is attached to the first fixing arm, and the second connecting portion is attached to the second fixing arms. The auxiliary suspension is directly opposite to and spaced apart from the elastic arms. The auxiliary suspension has a racetrack shape with notches passing through the racetrack. The notches are formed at two opposite sides of a long axis of the voice coil. With this structure, when the speaker is working, the auxiliary magnet units and the auxiliary diaphragms do not interfere with each other, such that the elastic members will not be easily broken, thereby greatly increasing the service life of the elastic members. In addition, the auxiliary diaphragms located at two opposite sides of a short axis of the voice coil each are a complete structure, without needing to provide an avoiding hole to avoid the auxiliary magnet units to prevent interference. Therefore, this structure strengthens the lateral rigidity of the vibration unit and effectively balances the lateral swing of the speaker, thereby improving the stability of the speaker.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker, comprising a frame;

a vibration unit supported in the frame; and a magnetic circuit unit driving the vibration unit to vibrate and produce sound, wherein the magnetic circuit unit is provided with a magnetic gap; the vibration unit comprises a diaphragm, and a voice coil inserted in the magnetic gap to drive the diaphragm to vibrate and produce sound; the magnetic circuit unit comprises a yoke fixed to the frame, a main magnet unit fixed to the yoke, and auxiliary magnet units located at two opposite sides of the main magnet unit and spaced apart from the main magnet unit, and the auxiliary magnet units and the main magnet unit define the magnetic gap; the voice coil has a rectangular structure with round corners; the vibration unit further comprises two elastic support assemblies fixed to the frame and opposite to and spaced apart from the diaphragm; the two elastic support assemblies are located at two opposite sides of a short axis of the voice coil; each of the two elastic support assemblies comprises an elastic member fixed to the frame, and an auxiliary diaphragm attached to a side of the elastic member away from the diaphragm and spaced apart from the auxiliary magnet unit; the elastic member comprises a first fixing arm fixed to the frame, at least one second fixing arm spaced apart from the first fixing arm to support the voice coil, and at least one elastic arm connecting the first fixing arm and the at least one second fixing arm; the auxiliary diaphragm comprises an auxiliary suspension, and a first connecting portion and a second connecting portion that respectively bend and extend from two opposite sides of the auxiliary suspension; the first connecting portion is attached to the first fixing arm, and the second connecting portion is attached to the at least one second fixing arm; the auxiliary suspension is directly opposite to and spaced apart from the at least one elastic arm; and the auxiliary suspension has a racetrack shape with notches passing through the racetrack, and the notches are formed at two opposite sides of a long axis of the voice coil.

2. The speaker as described in claim 1, wherein the auxiliary magnet unit comprises first auxiliary magnet units located at two opposite sides of the long axis of the voice coil and second auxiliary magnet units located at two opposite sides of the short axis of the voice coil; and the auxiliary diaphragms of the two elastic support assemblies are located at two opposite sides of the short axis of the voice coil and are spaced apart sides of the second auxiliary magnet units away from the voice coil.

3. The speaker as described in claim 2, wherein the vibration unit further comprises a holder configured to connect the diaphragm and the voice coil.

4. The speaker as described in claim 3, wherein the holder comprises four body portions attached to the round corners of the voice coil, a first extension wall bending and extending from sides of the four body portions away from the voice coil toward the frame and connected to the at least one second fixing arm, and a second extension wall bending and extending from a side of the first extension wall away from the four body portions to be connected to the diaphragm; the voice coil, the first extension wall and the second extension wall define an accommodating groove; and the first auxiliary magnet units and the second auxiliary magnet units are accommodated in the accommodating groove.

5. The speaker as described in claim 1, wherein the elastic member comprises two second fixing arms and two elastic arms; and the two elastic arms extend from the first fixing arm to be connected to the two second fixing arms.

6. The speaker as described in claim 4, wherein the diaphragm comprises a first suspension portion having a ring shape, a second suspension portion having a ring shape and spaced apart from and surrounding the first suspension portion, and a vibrating portion having a ring shape and located between the first suspension portion and the second suspension portion; a side of the first suspension portion away from the second suspension portion is fixed to the main magnet unit; a side of the second suspension portion away from the first suspension portion is fixed to the frame; a side of the first suspension portion close to the second suspension portion and a side of the second suspension portion close to the first suspension portion are attached to a side of the vibrating portion away from the voice coil; the second extension wall is attached to a side of the vibrating portion close to the voice coil; and the main magnet unit at least partially protrudes, through the first suspension portion, to be exposed to the diaphragm.

7. The speaker as described in claim 6, wherein the first suspension portion comprises a first fixing portion attached to the vibrating portion, a first suspension bending and extending from a periphery of the first fixing portion, a second fixing portion bending and extending from the first suspension and fixed to the main magnet unit, and a through hole penetrating through the second fixing portion; the main magnet unit is partially exposed, through the through hole, to an accommodating space defined by the diaphragm, the frame and the yoke; and the second suspension portion comprises a third fixing portion attached to the vibrating portion, a second suspension bending and extending from a periphery of the third fixing portion, and a fourth fixing portion bending and extending from the second suspension and fixed to the frame.

8. The speaker as described in claim 7, wherein the first suspension and the second suspension are recessed toward opposite directions.

9. The speaker as described in claim 8, wherein the first suspension bends and extends from the periphery of the first fixing portion in a direction away from the magnetic circuit unit, and the second suspension bends and extends from the periphery of the third fixing portion in a direction toward the magnetic circuit unit.

* * * * *